United States Patent [19]

Chapman

[11] 4,177,968

[45] Dec. 11, 1979

[54] CONCRETE FORMWORK SOLDIER

[75] Inventor: David Chapman, Bradford on Avon, England

[73] Assignee: Acrow (Engineers) Limited, London, England

[21] Appl. No.: 828,630

[22] Filed: Aug. 29, 1977

[51] Int. Cl.[2] ..... E04G 17/04; E04C 3/30

[52] U.S. Cl. ..... 249/211; 52/730

[58] Field of Search ..... 249/6, 26, 18, 187, 249/192, 210, 211, 40–48, 219 W; 52/338, 548, 549, 721, 731, 732, 729, 730, 356

[56] References Cited

U.S. PATENT DOCUMENTS

| | | | |
|---|---|---|---|
| 1,085,429 | 1/1914 | Kahn | 52/732 |
| 1,622,528 | 3/1927 | Marqua | 249/210 X |
| 2,125,691 | 8/1938 | Ragsdale | 52/731 |
| 2,134,155 | 10/1938 | Spinosa | 52/349 |
| 2,457,250 | 12/1948 | Macomber | 52/732 X |
| 2,950,787 | 8/1960 | Walsh | 52/732 |
| 3,185,267 | 5/1965 | Pavlecka | 52/731 X |
| 3,211,413 | 10/1965 | Low | 249/41 |
| 3,854,693 | 12/1974 | Kistler | 249/210 |
| 3,981,476 | 9/1976 | Alexander | 249/42 |
| 4,033,544 | 7/1977 | Johnston | 249/219 W X |
| 4,034,957 | 7/1977 | Cody | 249/18 X |

*Primary Examiner*—Richard B. Lazarus
*Assistant Examiner*—John S. Brown
*Attorney, Agent, or Firm*—Wood, Herron & Evans

[57] ABSTRACT

An elongate soldier for concrete framework comprising two spaced parallel substantially U-section members interconnected back to back in such a manner as to leave between the members, at least one channel or passage extending along the length of the soldier from each of its ends.

6 Claims, 8 Drawing Figures

CONCRETE FORMWORK SOLDIER

The invention relates to concrete formwork soldiers, i.e. members which in practice are intended to be erected in a substantially vertical position and to support concrete formwork panels, against which concrete is cast to produce vertical walls for dams, buildings and the like.

An elongate soldier for concrete formwork, in accordance with the invention, comprises two, spaced, parallel, substantially U-section members interconnected back to back in such a manner as to leave between the members at least one channel or passage extending along the length of the soldier from each of its ends.

Preferably, the members are fixed together by one or more connecting members which do not extend over the whole width of the U-section members so as to leave the channel(s) unobstructed.

There is preferably a channel on each of two opposite sides of the soldier, both channels desirably extending along the whole length of the soldier.

The soldier of the invention has the advantage that a number of such soldiers may be fixed end to end by means of members extending between the channels of one soldier, and those of an adjacent soldier, the members being fixed in the channels. Also, each soldier may be reinforced by members retained in the channels of the soldier. The members may be fixed in the channels by, for example, clamps, but preferably holes are formed in the sides of each channel so that the bolts or pins may be inserted through the holes to retain members in the channel. Furthermore, the channels in the soldiers may also be used to retain beams or studs forming part of the formwork and helping to support the formwork.

Holes may be provided in the flanges of each U-section member so as to provide a means of fixing walings, plumbing, access brackets and/or other ancillary equipment to the soldiers. Also, stiffeners comprising metal plates may be fixed between opposite flanges of each U-section member so as to strengthen the soldier and make it more rigid.

The soldier of the invention may be formed with aligned apertures in the U-section members for receiving walings, each waling extending through a number of soldiers in a direction transverse to the length of the soldiers. This has the advantage that the support structure is much narrower than that in which known soldiers are used, having walings fixed to and projecting from their backs.

The invention will now be further described by way of example, with reference to the accompanying drawings, in which.

Figure 1:
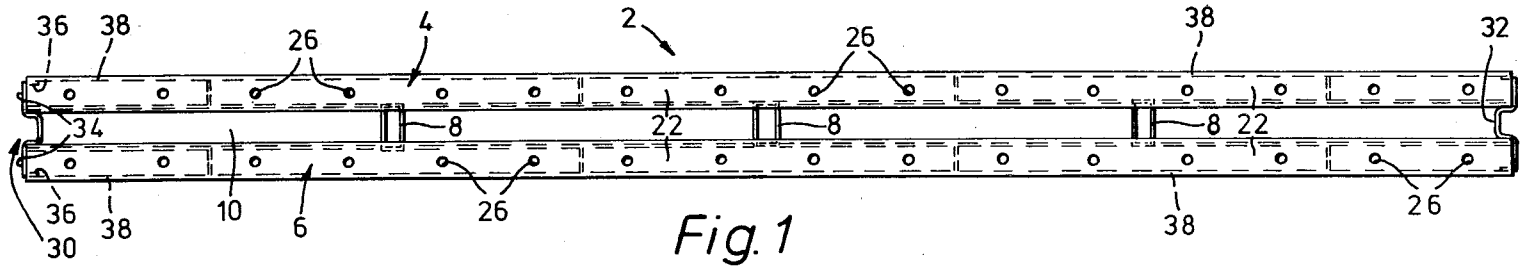
FIG. 1 is a front elevation of a soldier in accordance with the invention.
Figure 2:
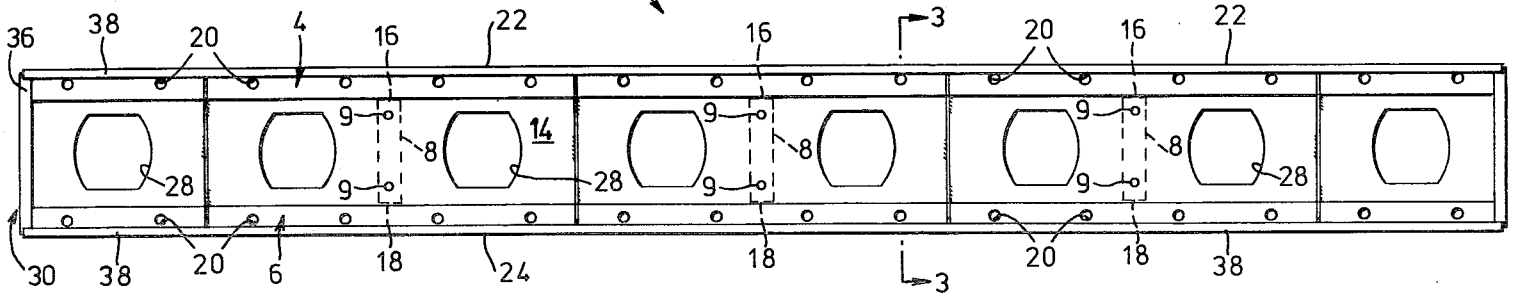
FIG. 2 is a side view of the soldier of FIG. 1.
Figure 3:
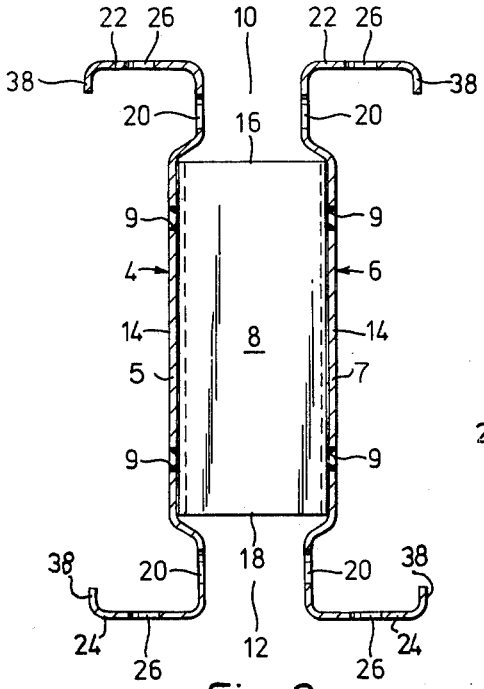
FIG. 3 is a section along lines 3—3 of FIG. 2.

Referring to FIGS. 1 to 3, a soldier generally indicated at 2 comprises two U-section members 4 and 6, which are interconnected back to back and spaced apart by means of three rectangular hollow section connecting members 8 which are fixed to the members' backs or webs 5, 7 by plug welds indicated at 9 (see FIG. 3). Obviously, the U-section members may be interconnected by other types of connecting members, and these need not be welded to the U-section members but may, for example, be bolted.

Figure 6:
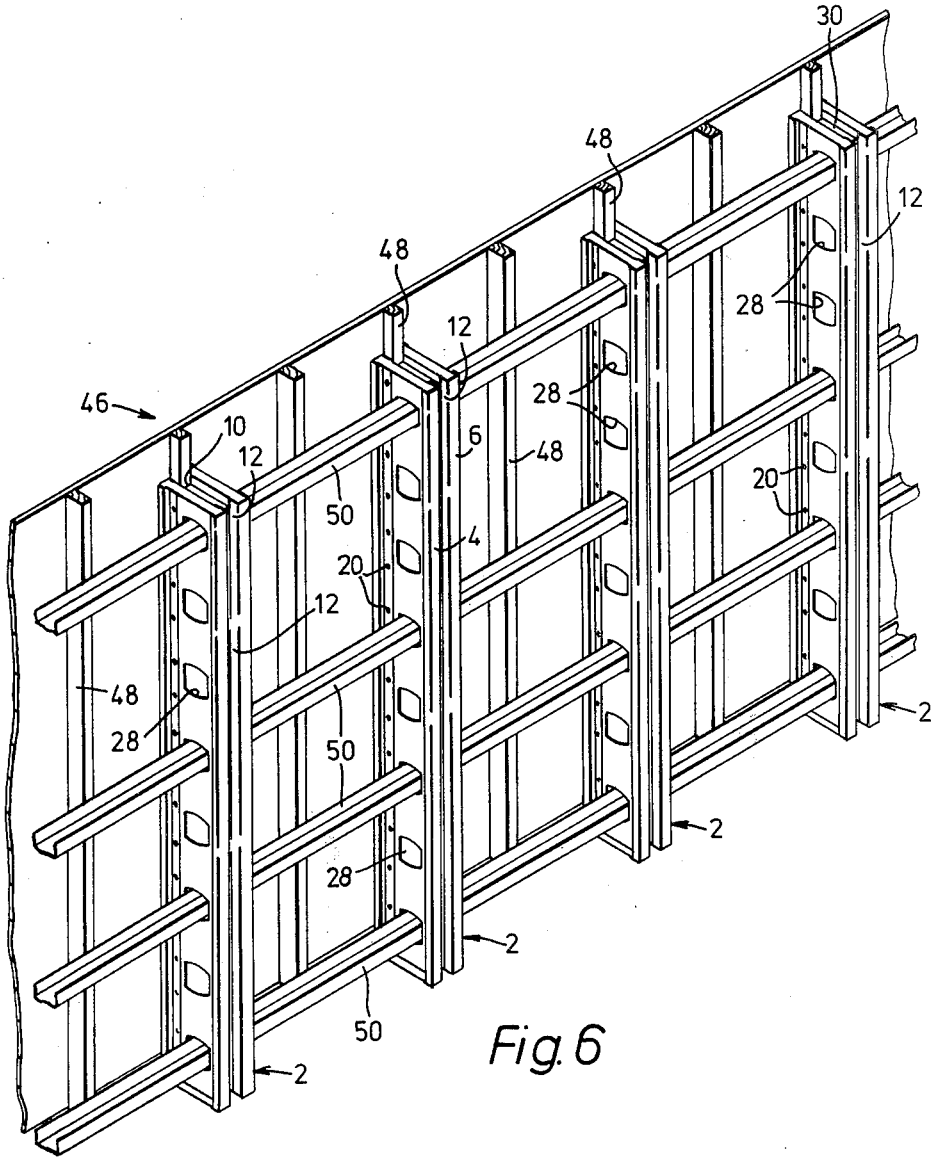

The end portions of the base of the members 4 and 6 define the sides of a pair of channels 10 and 12 extending down the length of the soldier from end to end for receiving elongate members such as vertical beams 48 as shown in FIG. 6, which preferably have rectangular, or square, hollow sections. The central part of each U-section member has a central recessed portion indicated at 14 and the connecting members 8 are fixed to these portions. The opposite ends 16 and 18 of the members 8 form an intermittent bottom surface for each of the channels 10 and 12.

The sides of the end portions of the U-section members 4 and 6 are each formed with a row of holes indicated at 20, the rows running along the sides of the channels 10 and 12. The members retained in the channels 10 and 12 may be fixed by means of pins or bolts extending through the holes 20 and aligned fixing holes in the members. These members may additionally have holes or slots perpendicular to these fixing holes, on the outer and inner surfaces of the members when they are fixed in the slots. Ties (not shown), may be arranged to extend through each soldier between its U-section members, and pass through these holes or slots to connect two adjacent formwork panel walls.

The side flanges 22 and 24 of the U-section members 4 and 6 are also formed with holes 26 to enable walings, plumbing, access brackets and/or other ancillary equipment to be fixed to the soldier, the holes in each member being aligned.

It will be appreciated that rigid elongate members may be fixed in the channels 10 and 12 of a soldier so as to reinforce the soldier. Also, the members may extend from the ends of the channels of a soldier into the ends of the channels of another soldier so as to rigidly connect the soldiers together.

The base of each U-section member 4 and 6 is formed with aligned apertures 28 spaced at intervals along the length of the soldier, for receiving walings.

Figure 4:
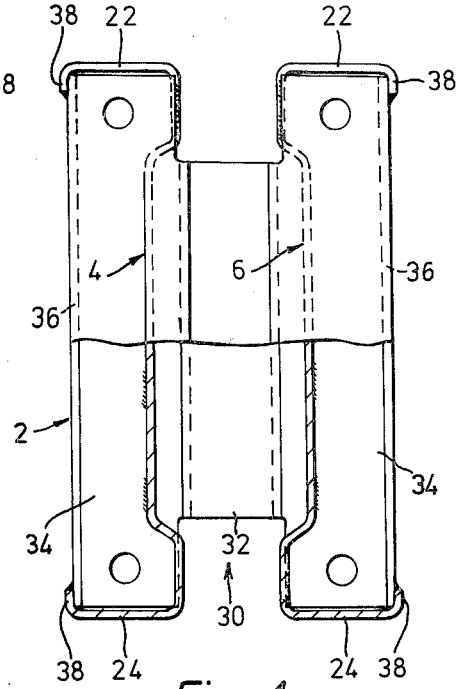
FIG. 4 is an end view of the soldier of FIG. 1.

Referring now to FIG. 4, each of the ends of the soldier 2 has an end plate 30 fixed thereto. The plate 30 is H-shaped in plan, the central part 32 of the plate being recessed so that it lies in a different plane from the sides 34 of the plate 30, see FIG. 1. The plate is located at the end of the soldier so that the central part 32 is positioned between the U-section members 4 and 6, the end parts 34 abutting the ends of the U-section members 4 and 6. The edges of the plate 30 are formed with flanges 36 (see FIG. 2) which are welded to turned-over edges or flanges 38 extending from flanges 22 and 24 of the U-section members 4 and 6. The fact that the central part 32 is recessed means that, when two soldiers are fixed end to end by splicing members extending between the channels of the soldiers, a tie may be passed through the soldiers, at their point of connection, and between the central parts 32 of adjacent end plates 30.

Figure 5:
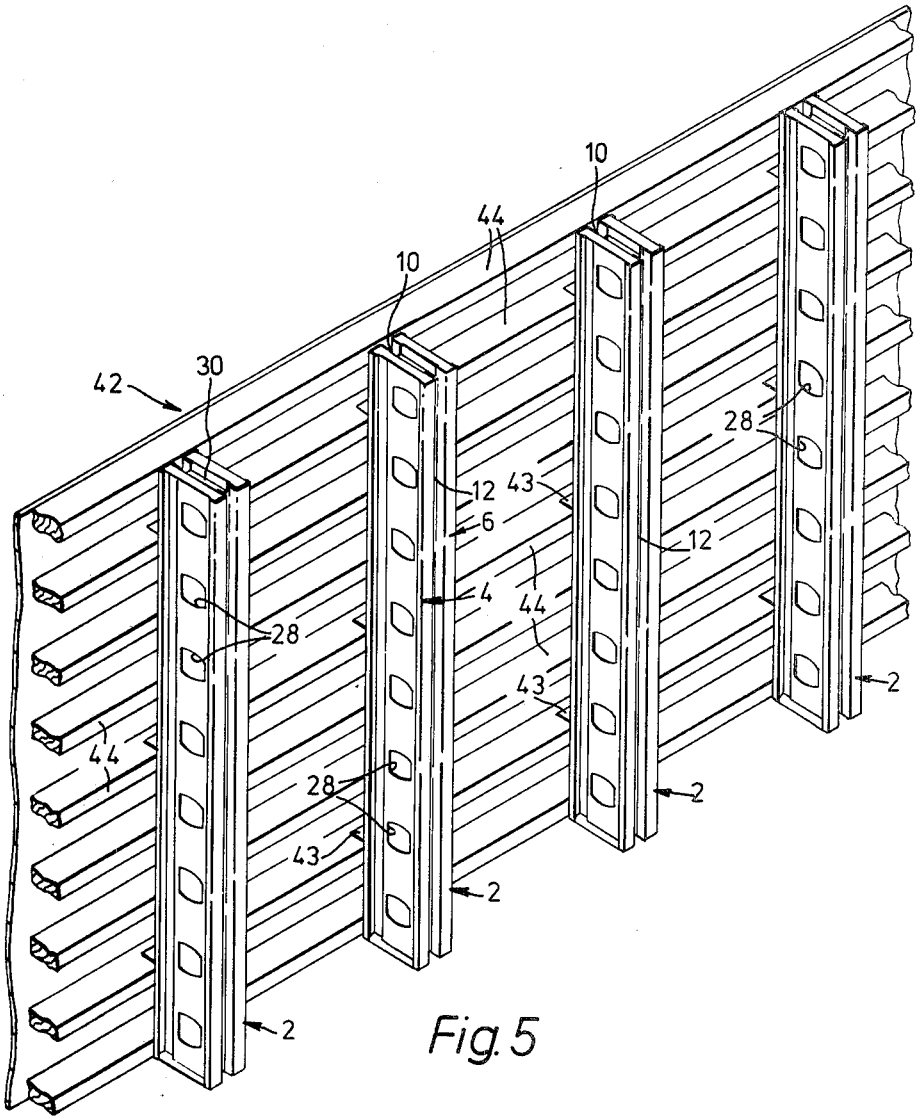
FIGS. 5 and 6 are perspective views of two types of concrete formwork supported by soldiers such as that shown in FIG. 1.

Referring to FIG. 5, the formwork indicated at 42 may be fixed to the sides of the soldiers 2 as shown, using for example clips, clamps or angle cleats such as are shown at 43, with parallel walings 44 extending transversely to the length of the soldiers 2, which soldiers abut these walings.

An alternative arrangement is shown in FIG. 6. In this case, the connector structure in the form of a number of parallel beams or studs 48 which extend parallel to the length of the soldiers 2. Some of the studs 48 are secured in the channels 10 of the soldiers so that the formwork is supported by the soldiers. The studs may be fixed in the channels by for example pins or nails extending through holes 20. Walings 50 extend transversely to the length of the soldiers and through apertures 28. They may be fixed to the soldiers by, for example, clamps. It will be appreciated that the width of the support structure shown in FIG. 6 is considerably narrower than would be the case if conventional soldiers having no apertures 28 were used and walings 50 were fixed to the soldiers along, and projecting from, their backs.

Figure 7:
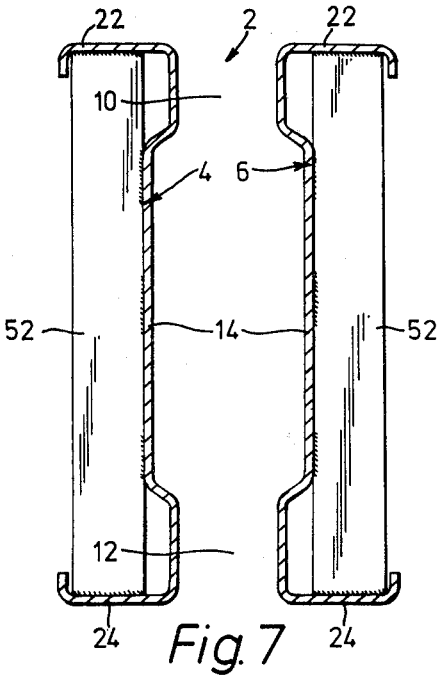
FIG. 7 is a section through the soldier of FIG. 1 showing a soldier having stiffeners fixed to its U-section members.

FIG. 7 shows U-section members 4 and 6 having stiffeners in the form of metal plates 52. Each plate 52 is welded to the flanges 22 and 24 of each member 4 and 6 and also to the central recessed portion 14 of each member. The plates 52 serve to strengthen the soldier 2, and make it more rigid.

Figure 8:
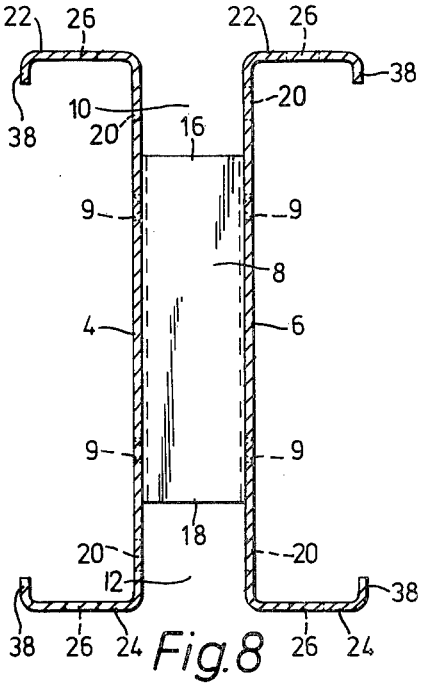
FIG. 8 is a sectional elevation, similar to that of FIG. 3, of an alternative embodiment.

An alternative embodiment of the invention is illustrated in FIG. 8. The construction of the soldier is generally the same as that of the embodiment already described and the same reference numerals are used. However, in the FIG. 8 embodiment the central part of each U-section member, to which the connecting members 8 are fixed, is planar, the recessed portions indicated at 14 in FIG. 3 being foregone.

What we claim is:

1. A concrete formwork soldier for use with concrete formwork, said soldier comprising two elongated members positioned parallel one to the other, each of said members having a generally U-shaped cross-sectional configuration, said members being positioned in back-to-back relation with side flanges of said members extending away one from another, and said members being positioned to establish a space between backs of said members, and a plurality of connecting members positioned between the backs of said elongated members within said space, each connecting member being connected to the backs of both of said elongated members for restraining said members in spaced, back-to-back relation, said connecting members themselves being located in spaced relation one from the other from one end of said elongated members to the other, opposite ends of said connecting members cooperating with the backs of said elongated members to define two separate channels extending the length of said soldier from one end to the other end for use in connecting said soldier to concrete formwork, said channels being located opposite one another and separated by said connecting members, each of said channels being located inwardly of the side flanges of said members within said space established between backs of said members.

2. A soldier as set forth in claim 1, said soldier comprising a reinforcement member secured in one of said channels.

3. A soldier as set forth in claim 1, said soldier comprising a stiffener plate fixed between opposite flanges of at least one of said elongated members.

4. A soldier as set forth in claim 1, said soldier comprising at least one hole defined in the back of each elongated member, each hole in one elongated member being generally aligned with a hole in the other elongated member, said hole pair in each soldier being adapted to receive a waling therethrough for restraining at least two of said soldiers in connected relation.

5. Concrete formwork comprising a plurality of soldiers, each of said soldiers comprising two elongated members positioned parallel one to the other, each of said members having a generally U-shaped cross-sectional configuration, said members being positioned in back-to-back relation with side flanges of said members extending away one from another, and said members being positioned to establish a space between backs of said members, and a plurality of connecting members positioned between the backs of said elongated members within said space, each connecting member being connected to the backs of both of said elongated members for restraining said members in spaced, back-to-back relation, said connecting members themselves being located in spaced relation one from the other from one end of said elongated members to the other, opposite ends of said connecting members cooperating with the backs of said elongated members to define two separate channels extending the length of said soldier from one end to the other end for use in connecting said soldier to concrete formwork, said channels being located opposite one another and separated by said connecting members, each of said channels being located inwardly of the side flanges of said members within said space established between backs of said members, and a concrete formwork panel extending across the side flanges of said soldiers on at least one side thereof, said panel being connected with each of said soldiers by connector structure received in one of said channels defined by said elongated members and said connecting members.

6. Concrete formwork as set forth in claim 5, at least one hole defined in the back of each elongated member, each hole in one elongated member being generally aligned with a hole in the other elongated member, and including a waling through said hole pair in each soldier restraining at least two of said soldiers in connected relation.

* * * * *